US011548698B2

(12) United States Patent
Finckelsen

(10) Patent No.: US 11,548,698 B2
(45) Date of Patent: Jan. 10, 2023

(54) RECLOSURE SYSTEM AND THE USE OF SUCH RECLOSURE SYSTEM

(71) Applicant: Nordic-Battleland AB, Boden (SE)

(72) Inventor: Torry Finckelsen, Boden (SE)

(73) Assignee: NORDI-BATTLELAND AB, Boden (SE)

( * ) Notice: Subject to any disclaimer, the term of this patent is extended or adjusted under 35 U.S.C. 154(b) by 365 days.

(21) Appl. No.: 16/621,170

(22) PCT Filed: Jun. 8, 2018

(86) PCT No.: PCT/EP2018/065157

§ 371 (c)(1),
(2) Date: Dec. 10, 2019

(87) PCT Pub. No.: WO2018/228941

PCT Pub. Date: Dec. 20, 2018

(65) Prior Publication Data

US 2020/0198861 A1 Jun. 25, 2020

(30) Foreign Application Priority Data

Jun. 12, 2017 (SE) ..... 1750743-5

(51) Int. Cl.
*B65D 51/16* (2006.01)
*B65D 47/12* (2006.01)
(Continued)

(52) U.S. Cl.
CPC ..... *B65D 51/1633* (2013.01); *B65D 47/122* (2013.01); *B65D 47/125* (2013.01);
(Continued)

(58) Field of Classification Search
CPC ..... B65D 2251/09; B65D 2543/0025; B65D 1/0246; B65D 39/08; B65D 39/084;
(Continued)

(56) References Cited

U.S. PATENT DOCUMENTS 1,755,944 A 4/1930 Adams
3,409,159 A * 11/1968 Velt ..... B65D 50/067 215/215

(Continued)

FOREIGN PATENT DOCUMENTS

CN 1697757 A 11/2005
CN 101784453 A 7/2010

(Continued)

*Primary Examiner* — Don M Anderson
*Assistant Examiner* — Jennifer Castriotta
(74) *Attorney, Agent, or Firm* — Hodgson Russ LLP

(57) ABSTRACT

A reclosure system comprising a bottle and a reversible lid. The bottle comprises a bottle neck having an axial extension and a mouth providing access to the interior of the bottle. The bottle neck comprises a circumferential wall portion being provided with a first locking means. A first side of the reversible lid comprises a collar comprising a second locking means configured to selectively allow the reversible lid to sealingly close off the mouth of the bottle neck by the second locking means engaging the first locking means of the bottle neck. A second side of the reversible lid, opposite the first side, comprises a third locking means configured to selectively engage the bottle neck, to define a through-going venting hole in an interface between the reversible lid and the bottle neck, said through-going venting hole allowing a communication between the interior and exterior of the bottle.

7 Claims, 8 Drawing Sheets

(51) Int. Cl.
*B65D 55/02* (2006.01)
*A45F 3/16* (2006.01)

(52) U.S. Cl.
CPC ..... *B65D 55/02* (2013.01); *A45F 3/16* (2013.01); *B65D 2205/02* (2013.01); *B65D 2251/09* (2013.01); *B65D 2543/0025* (2013.01)

(58) Field of Classification Search
CPC .. B65D 39/086; B65D 41/04; B65D 41/0428; B65D 47/122; B65D 47/125; B65D 51/1622; B65D 51/1661; B65D 51/1688; B65D 51/1605; B65D 2205/02
See application file for complete search history.

(56) References Cited

U.S. PATENT DOCUMENTS 3,831,796 A * 8/1974 Claasen ..... B65D 50/067 215/215
3,865,267 A * 2/1975 Morris ..... B65D 50/061 215/214
4,526,281 A * 7/1985 Herr ..... B65D 55/02 215/222
5,711,442 A * 1/1998 Kusz ..... B65D 50/046 215/221
5,899,348 A * 5/1999 Konefal ..... B65D 50/046 215/221
6,164,483 A 12/2000 Walker
2004/0198623 A1 10/2004 Calvert et al.
2005/0230341 A1* 10/2005 Dong ..... B65D 41/0414 215/222
2012/0318788 A1 12/2012 Austin

FOREIGN PATENT DOCUMENTS

CN 105346825 A 2/2016
FR 2941440 A1 7/2010
JP 2002120877 A 4/2002
WO 02/092458 A2 11/2002

* cited by examiner

RECLOSURE SYSTEM AND THE USE OF SUCH RECLOSURE SYSTEM

TECHNICAL FIELD

The present invention refers to a reclosure system comprising a bottle and a reversible lid and the use of such reclosure system.

TECHNICAL BACKGROUND

A bottle is typically made of a plastics material and is provided with a threaded cap to allow easy opening and re-filling. The same principle is also known to other types of bottles using a threaded lid.

It is important that the bottle and the lid is washed between uses. Also, to avoid bad taste and smell by any liquid being stuck inside the bottle after washing or between uses it is important that the bottle is properly dried before re-mounting the lid. During drying it is easily happened that the lid is moved and lost, e.g. when emptying the dish drainer. Also, in case of the bottle being a sports bottle, many sports bottles are used at the same time whereby the user must find out which cap matches which bottle.

In many cases there is also a risk of bad smell being developed after washing and drying if the bottle is stored with the lid mounted thereto. Residues or plasticizers may cause this.

The most common solution to these problems is to instead store the bottle and the lid as separate items. This however increases the risk of the lid being lost. One measure to keep track of the lid is to have the same connected to the bottle by a string or tongue. This does however change the center of mass of an open and empty bottle, thereby risking tipping over and causing a domino-effect when storing in e.g. a cupboard together with other empty bottles. Also, when storing in racks, which is common when using sports bottles in team sports, such connected lids will interfere with the available space in the rack.

The problems mentioned above are not restricted to sports bottles but do also apply to other types of containers, such as preserving jars, lunch boxes and containers in general. The problems apply not only for containers for food and beverages but also for other applications such as medical or laboratory vessels.

There is accordingly a need for a solution that allows the bottle and its closure means to be handled as one single unit when not in use.

SUMMARY

One object of the invention is to provide a system comprising a bottle and a lid where the lid may be connected to the bottle when the bottle is not in use while still allowing proper drying and venting of the bottle.

Another object of the invention is to provide a system where the lid may be connected to the bottle when the bottle is not in use without undue interference with other items.

Another object of the invention is to provide a hygienic bottle that prevents development of bad smell and taste and which thereby exhibits a prolonged useful length of the bottle.

These and other objectives are solved by a reclosure system comprising a bottle and a reversible lid, wherein the bottle comprises a bottle neck having an axial extension and a mouth providing access to the interior of the bottle, and said bottle neck further comprising a circumferential wall portion being provided with a first locking means, and the reversible lid being configured to be removably connected to the bottle neck, wherein a first side of the reversible lid comprises a collar comprising a second locking means configured to selectively allow the reversible lid to sealingly close off the mouth of the bottle neck by the second locking means engaging the first locking means of the bottle neck, and a second side of the reversible lid, opposite the first side, comprising a third locking means configured to selectively engage the bottle neck; whereby in a condition when the third locking means engages the bottle neck, a through-going venting hole is defined in an interface between the reversible lid and the bottle neck, said through-going venting hole allowing a communication between the interior of the bottle and the ambience.

By this type of reclosure system several advantages are provided. Since the lid is reversible, the lid can be selectively mounted to the bottle in two different directions at the user's choice by turning it upside-down. During normal operation when the lid is mounted to the bottle, the lid will effectively close-off the mouth. When the bottle is empty and not in use, the user can turn the reversible lid up-side-down and mount the lid to the bottle neck by engaging the third locking means of the lid with the bottle neck. In this position the through-going venting hole in the neck will be open and allow the interior of the bottle to communicate with the ambience. Thereby any fluid or residues remaining in the bottle after use or after washing will be allowed to freely evaporate. Also, even though the bottle should be completely dry, any gases causing bad smell or bad taste will be allowed to evaporate. Bad smell and bad taste may be caused by residues or plasticizers. Thereby the useful length of the bottle will be prolonged. As yet another advantage, there is no risk of the lid getting lost during storing of the bottle since the lid will be attached to the bottle. Also, there is no risk of the lid of a first empty bottle interfering with a second adjacent bottle causing an entangling with or a tipping-over of adjacent bottles or items, which is often the case when storing several empty bottles in a cup-board, on a shelf or in a rack. Also, there is no need for time-consuming match-making between lids and bottles. The through-going venting hole may have a substantially radial extension or a substantially radial and/or axial extension. The extension is a result of the design of the bottle neck and/or the lid.

The third locking means of the lid may be complementary to the first locking means of the bottle neck, and the third locking means of the lid may be configured to selectively engage the first locking means of the neck while not interfering with the through-going venting hole.

At least the first locking means and the second locking means may be threads.

The through-going venting hole may be a cut-out in a free upper edge of the bottle neck, or alternatively, the through-going venting hole may be a bore formed in the circumferential wall portion of the bottle neck. It is to be understood that the geometry of the cut-out or the bore may have different shapes with remained function. It is also to be understood that the number of cut-outs or bores may be altered with remained function. At least one cut-out or bore should be provided. In case of a cut-out in a free upper edge of the bottle neck, it is preferred that at least a portion of the free upper edge of the bottle neck is continuous. Thereby such continuous portion may form an abutment surface against an inner wall portion of the reversible lid.

The bottle neck may comprise a radially extending first sealing surface, and the collar of the reversible lid may comprise a complementary circumferential second sealing surface configured to sealingly abut the first sealing surface in a condition when the reversible lid is mounted to the bottle neck with the second locking means engaging the first locking means. Thereby a fluid tight engagement between the lid and the bottle neck may be provided for. The skilled person will understand that de design of the sealing surfaces and their positions may be altered with remained function.

The third locking means may be provided by an axially and circumferentially extending abutment surface configured to engage an inner portion of the circumferential wall portion of the bottle neck. The engagement between the abutment surface and the inner wall portion may be provided by friction only. It is to be understood that one of the surfaces, preferably the abutment surface may be provided with friction enhancing means.

The circumferentially extending abutment surface may have a dis-continuous circumferential extension forming at least one radially and axially extending depression, wherein said at least one depression in a condition when the third locking means engages the bottle neck defines a substantially radially and axially extending passage forming said through-going venting hole.

The circumferentially extending abutment surface may, as seen in the axial direction, have a height being smaller than a maximum depth of the cut-out in the free upper edge of the bottle neck, whereby in a condition when the third locking means engages the bottle neck, a substantially radially extending passage forming the through-going venting hole is defined.

The third locking means of the reversible lid may be complementary to the first locking means of the bottle neck, and the third locking means of the reversible lid may be configured to selectively engage the first locking means without the collar of the reversible lid closing-off the through-going venting hole in the bottle neck.

An effective engagement area between the first and the second locking means as seen along the axial extension of the bottle neck may be larger than the effective engagement area between the bottle neck and the third locking means. In the context of the invention the term "effective engagement area" is to be interpreted as the overlapping surface area between engaging parts. By way of example, in a case where the locking means are threads, the effective engagement area is determined by the number of threads. Thus, the number of threads forming the first and the second locking means may be larger than the number of threads of the third locking means.

The first locking means may be arranged on an inner envelope surface of the circumferential wall portion of the bottle neck and the second locking means may be arranged on an outer envelope surface of the collar of the reversible lid; or the first locking means may be arranged on an outer envelope surface of the circumferential wall portion of the bottle neck and the second locking means may be arranged on an inner envelope surface of the collar.

The first locking means may be arranged on an exterior portion of the circumferential wall portion of the bottle neck, or the first locking means may be arranged on an inner portion of the circumferential wall portion of the bottle neck.

The neck may further comprise a fourth locking means, wherein the fourth locking means may be configured to selectively engage the third locking means of the lid.

The third locking means of the lid and the fourth locking means of the neck may together form a bayonet joint. A bayonet joint provides the advantage that it is easily operable by a simple twisting movement thereby allowing the lid to remain attached to the bottle.

The lid may comprise a nozzle providing a through-going opening extending from the first side of the lid to the second side of the lid. The nozzle may by way of example be a re-closable nozzle which is operate by the user's lips or teeth by moving a closure means along an axial direction between a closed position and an open position. The nozzle may by way of example be a flexible tubing. As yet another example the nozzle may be a hollow pipe with a removable cap. Numerous nozzles are present on the market and the invention should not be restricted to the type of nozzle used.

In one embodiment, the reclosure system may be described as comprising a bottle and a reversible lid, the bottle comprising a neck having an axial extension and a mouth providing access to the interior of the bottle, wherein said neck comprising a circumferential wall portion provided with a first locking means, and wherein the circumferential wall portion further comprises a through-going venting hole; and the reversible lid being configured to be removably connected to the neck, wherein a first side of the lid comprises a collar comprising second locking means configured to selectively allow the lid to sealingly close off the mouth of the neck by the second locking means engaging the first locking means of the neck while the collar closes-off the through-going venting hole in the circumferential wall portion of the neck, and a second side of the lid, opposite the first side, comprises a third locking means configured to selectively engage the neck of the bottle without the lid closing-off the through-going venting hole.

According to another aspect, the invention refers to the use of a reclosure system with the features given above in a reclosable bottle to be used for food, beverages or medical or laboratory experiments.

Further objects and advantages of the present invention will be obvious to a person skilled in the art reading the detailed description given below describing different embodiments.

BRIEF DESCRIPTION OF THE DRAWINGS

The invention will be described in detail with reference to the schematic drawings.

DETAILED DESCRIPTION

In the description to follow, a reclosure system comprising a bottle 100*a* and a reversible lid 200*a* according to a first embodiment will be disclosed. As non-limiting examples, the bottle 100*a* may be a bottle, a sports bottle or a thermos flask. The bottle 100*a* may be applicable to food or beverages, but it can also be applicable for other purposes such as a bottle to be used in medical or laboratory experiments. Typical examples of bottles for medical or laboratory experiments are test tubes and flasks. It is to be understood that the principle is also applicable to other types of containers such as a preserving jar or a lunch box.

The bottle 100*a* may be formed by a plastic material, glass or metal. The lid 200*a* may be formed by a plastic material, glass or metal. The bottle 100*a* and the lid 200*a* may be formed by one and the same material or by different materials. The bottle and/or lid may also be formed by more than one material.

Figure 1:
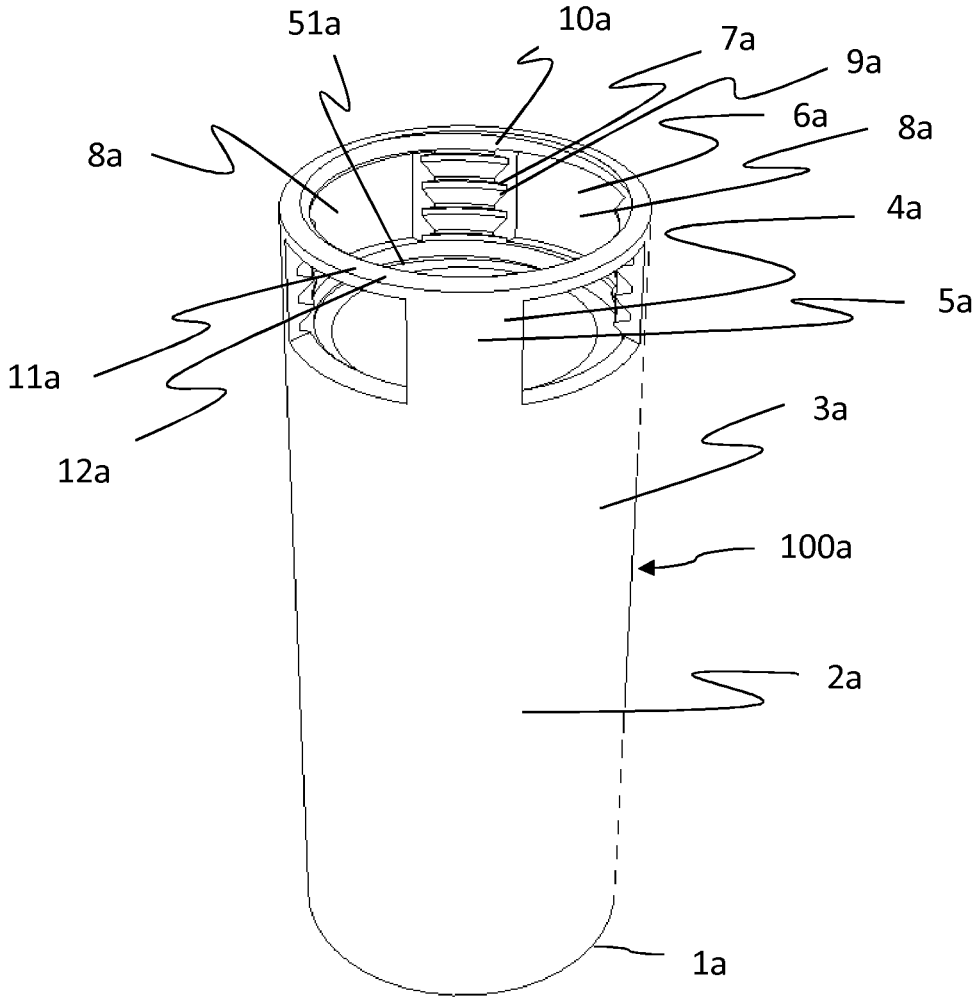
FIG. 1 discloses a first embodiment of a bottle.

Now turning to FIG. 1, a first embodiment of a bottle 100*a* is disclosed. The bottle 100*a* has a bottom wall 1*a* and a side wall portion 2*a*. The side wall portion 2*a* together with the bottom wall 1*a* delimit a compartment 3*a*. Although the bottle 100*a* is disclosed as a cylinder having a circular cross-section it is to be understood that other cross-sections are possible. Also, depending on the cross-section, the number of side wall portions may vary.

The bottle 100*a* has a bottle neck 4*a*. The bottle neck 4*a* comprises a circumferential wall portion 5*a* having an axial extension. The neck 4*a* has a circular cross-section. The neck 4*a* has a mouth 6*a* in its free end. The mouth 6*a* forms a through-going opening extending along the axial extension of the neck 4*a* and provides access to the interior, i.e. the compartment 3*a* of the bottle 100*a*.

The circumferential wall portions 5*a* of the neck 4*a* is as seen in its circumferential direction divided into portions provided with first locking means 7*a* and portions provided with through-going venting holes 8*a*.

The first locking means 7*a* is formed by threads 9*a*. The threads 9*a* are arranged along the inner portion 10*a* of the circumferential wall portion 5*a*. Three turns of the threads 9*a* are disclosed. It is to be understood that more than three turns may be provided. Although the threads 9*a* are divided into a plurality of threaded portions, the threaded portions together allow a continuous threaded engagement with the lid 200*a* to be mounted to the neck 4*a*. The threaded portions are preferably equally distributed in the circumferential direction.

The through-going venting holes 8*a* extend in the radial direction of the bottle neck 4*a*. The through-going venting holes 8*a* are formed as radially extending bores. Three venting holes 8*a* are disclosed. The number of venting holes 8*a* may be at least one. In case of more than one venting hole 8*a*, the venting holes 8*a* may be circumferentially equally distributed across the circumferential wall portion 5*a*. It is to be understood that the through-going venting holes 8*a* may have any arbitrary cross-section.

The upper edge 11*a* of the bottle neck 4*a* is provided with a circumferential continuous edge 12*a*.

Figure 2:
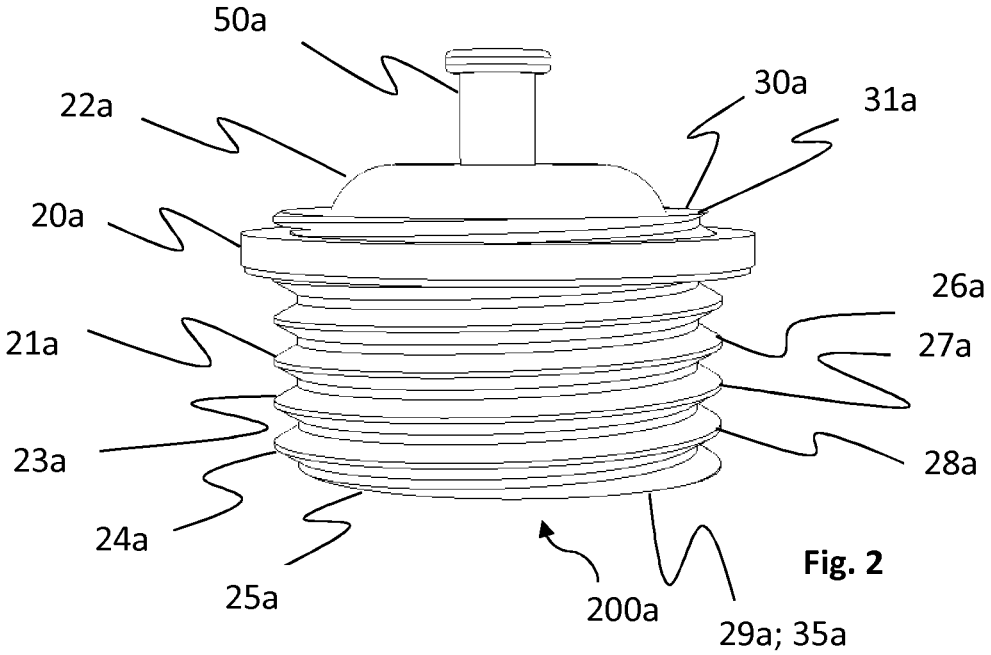
FIG. 2 discloses a lid adapted to be used together with the bottle of the first embodiment.

Now turning to FIG. 2, a reversible lid 200*a* is disclosed. The lid 200*a* is configured to be removably connected to the bottle neck 4*a* of the bottle 100*a* of FIG. 1. The lid 200*a* is reversible, meaning that it can be selectively mounted to the bottle 100*a*, at the choice of the user, in two different directions by turning the lid 200*a* upside-down.

The lid 200*a* comprises a radially extending disc 20*a* having a cross-section exceeding the cross-section of the mouth 6*a* of the bottle 100*a*. The lid 200*a* has a first side 21*a* and an opposite second side 22*a*.

The lid 200*a* may comprise an optional nozzle 50*a* providing a through-going opening extending from the first side 21*a* of the lid 200*a* to the second side 22*a* of the lid 200*a*.

The first side 21*a* of the lid 200*a* comprises a collar 23*a* extending in the axial direction of the lid 200*a*. The collar 23*a* comprises a circumferential side wall portion 24*a* having an inner envelope surface 25*a* and an outer envelope surface 26*a*. The outer envelope surface 26*a* is provided with a second locking means 27*a*. The second locking means 27*a* is complementary to the first locking means 7*a* provided by the bottle 100*a*. Thus, the second locking means 27*a* is formed by threads 28*a* having a profile mating with the threads 9*a* of the first locking means 7*a*. When the lid 200*a* is mounted to the neck 4*a* of the bottle 100*a* via the first side 21*a* of the lid 200*a*, the effective engagement area is provided by the threads 9*a* of the first locking means 7*a* engaging the threads 28*a* of the second locking means 27*a*.

Figure 3:
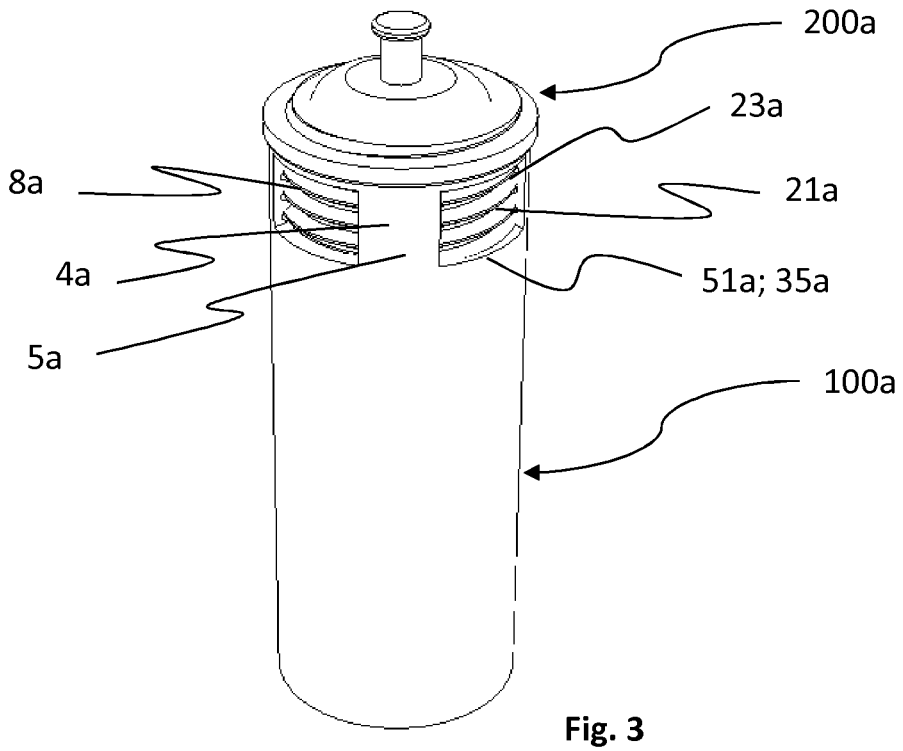
FIG. 3 discloses the lid mounted to the bottle via its first side.

The collar 23*a* has an axial extension sufficient to close-off the through-going venting holes 8*a* in the circumferential wall portion 5*a* of the neck 4*a* when the lid 200*a* is mounted via its first side 21*a* to the neck 4*a* of the bottle 100*a*. The lid 200*a* thereby acts as a traditional lid, completely closing-off the neck 4*a* and its mouth 6*a* in a leak-free manner. This is best seen in FIG. 3.

An edge 29*a* of the collar 23*a* forming a second sealing surface 35*a* may sealingly abut a complementary circumferential first sealing surface 51*a* in the bottle 100*a* when the lid 200*a* is mounted to the neck 4*a*. The first sealing surface 51*a* and/or the second sealing surface 35*a* may be provided with an elastic sealing member (not disclosed).

The second side 22*a* of the lid 200*a* comprises third locking means 30*a*. The third locking means 30*a* are configured to selectively engage the neck 4*a* of the bottle 100*a* without the lid 200*a* closing-off the through-going venting hole(s) 8*a*. The third locking means 30*a* are provided as threads 31*a*. In the disclosed embodiment one turn of threads 31*a* is disclosed. More than one turn of threads 31*a* may be used. When the lid 200*a* is mounted to the neck 4*a* of the bottle 100*a* by using the second side 22*a* of the lid 200*a*, the effective engagement area is provided by the threads 31*a* of the third locking means 30*a* engaging the threads 9*a* of the first locking means 7*a*.

Figure 4:
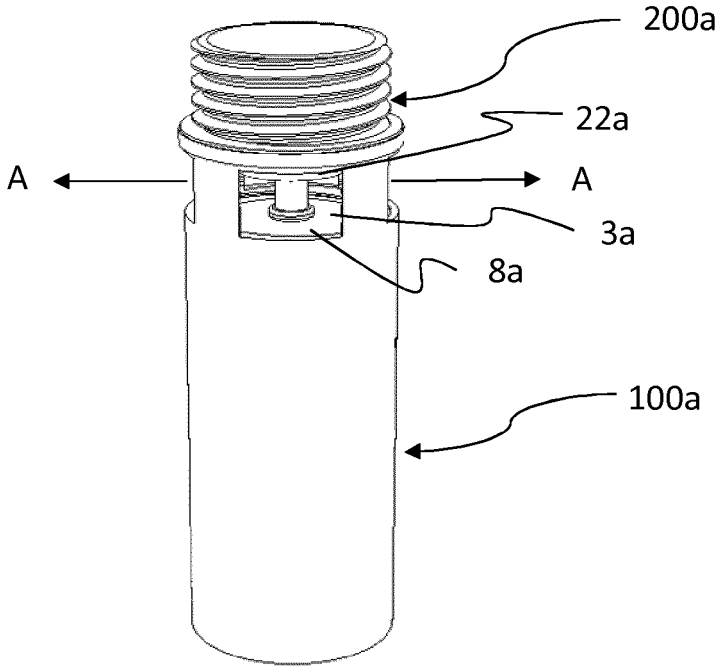
FIG. 4 discloses the lid mounted to the bottle via its second side.

Now turning to FIG. 4, the bottle 100*a* is disclosed with the lid 200*a* being mounted to the bottle 200*a* via its second side 22*a*. In this position the lid 200*a* is attached to the bottle 100*a*, however the venting holes 8*a* will remain open. Thereby, the venting-holes 8*a* provide a free passage extending in the radial direction (arrow A) allowing the interior of the compartment 3*a* to communicate with the ambience. Any fluid or residues remaining in the bottle 100*a* after use or after washing the bottle 100*a* will be allowed to freely evaporate through the venting holes 8*a*. Even though the bottle 100*a* should be completely dry, any gases causing bad smell or bad taste caused by residues or plasticizers will be allowed to evaporate. Thereby the useful length of the bottle 100*a* will be prolonged. Also, the risk of any residues causing growth of biological matter is greatly reduced. As yet another advantage, there is no risk of the lid 200*a* getting lost during storing of the bottle 100*a* since the lid 200*a* will be attached to the bottle 100*a*.

Figure 5:
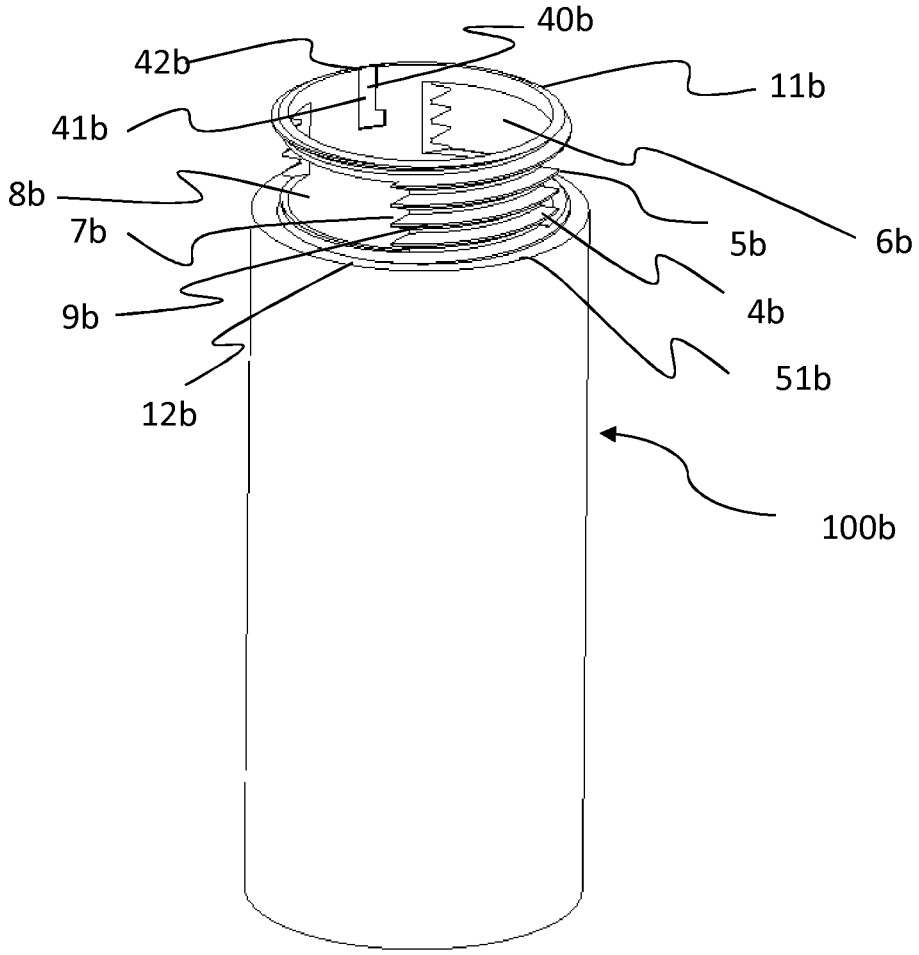
FIG. 5 discloses a second embodiment of a bottle.

Now turning to FIG. 5, a second embodiment of the bottle 100*b* is disclosed. The bottle 100*b* of FIG. 5 differs from the bottle of FIG. 1 in the design of the neck 4*b*. The circumferential wall portion 5*b* is as seen in its circumferential direction divided into portions provided with first locking means 7*b* and portions provided with through-going venting holes 8*b*. The upper edge 11*b* of the neck 4*b* is provided with a circumferential continuous edge 12*b*.

The first locking means 7*b* is formed by threads 9*b*. The threads 9*b* are arranged along the outer envelope surface of the circumferential wall of the neck 4*b*. Four turns of the threads 9*b* are disclosed. It is to be understood that more or fewer than four turns may be provided. Although the threads 9*b* are divided into a plurality of threaded portions, the threaded portions together allow a continuous threaded engagement with the lid 200*b* to be mounted to the neck 4*b*. The threaded portions are preferably equally distributed in the circumferential direction. The inner circumferential wall portion of the neck 4*b* may be smooth.

The through-going venting holes 8*b* extend in the radial direction of the neck 4*b*. Two venting holes 8*b* are disclosed. The number of venting holes 8*b* may be at least one. In case of more than one venting hole 8*b*, the venting holes 8*b* may be circumferentially equally distributed across the circumferential wall portion. The through-going venting holes 8*b* may have any arbitrary cross-section.

The inner envelope surface of the neck 4*b* comprises a fourth locking means 40*b* arranged in an area between two through-going venting holes 8*b*. The fourth locking means 40*b* is arranged to engage a third locking means of the lid 200*b*, to be described below.

The fourth locking means 40*b* is formed as a groove 41*b* arranged in the inner envelope surface of the circumferential wall. The groove 41*b* is disclosed as having an L-shape with one open end 42*b* facing the free edge of the neck 4*b*. It is to be understood that other extensions are possible. The groove 41*b* may be through-going as seen in the radial direction of the neck 4*b* or have a bottom as seen in the radial direction of the neck 4*b*.

Figure 6:
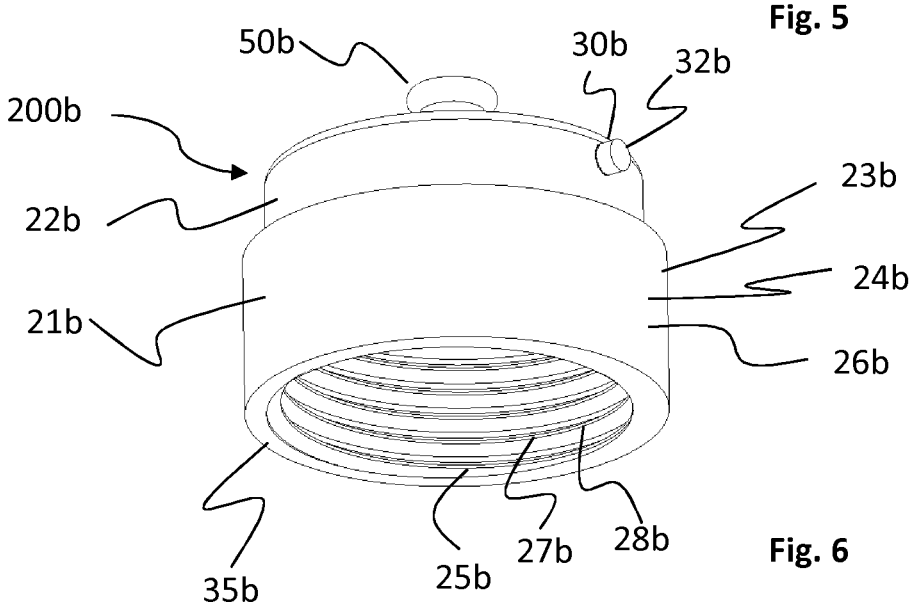
FIG. 6 discloses a lid adapted to be used together with the bottle of the second embodiment.

Now turning to FIG. 6, a reversible lid 200*b* is disclosed. The lid 200*b* is configured to be removably connected to the neck 4*b* of the bottle 100*b* of FIG. 5. The lid 200*b* is reversible, meaning that it can be selectively mounted to the bottle 100*b* in two different directions by turning it upside-down at the user's choice.

The lid 200*b* has a first side 21*b* and an opposite second side 22*b*. The lid 200*b* may comprise an optional nozzle 50*b* providing a through-going opening extending from the first side 21*b* of the lid 200*b* to the second side 22*b* of the lid 200*b*.

The first side 21*b* of the lid 200*b* comprises a collar 23*b* extending in the axial direction of the lid 200*b*. The collar 23*b* comprises a circumferential side wall portion 24*b* having an inner envelope surface 25*b* and an outer envelope surface 26*b*. The inner envelope surface 25*b* is provided with a second locking means 27*b*. The second locking means 27*b* is complementary to the first locking means 7*b* provided on the neck 4*b* of the bottle 100*b*. Thus, the second locking means 27*b* is formed by threads 28*b* having a profile mating with the threads 9*b* of the first locking means 7*b*. When the lid 200*b* is mounted to the neck 4*b* of the bottle 100*b* via the first side 21*b* of the lid 200*b*, the effective engagement area is provided by the threads 9*b* of the first locking means 7*b* engaging the threads 28*b* of the second locking means 27*b*.

Figure 7:
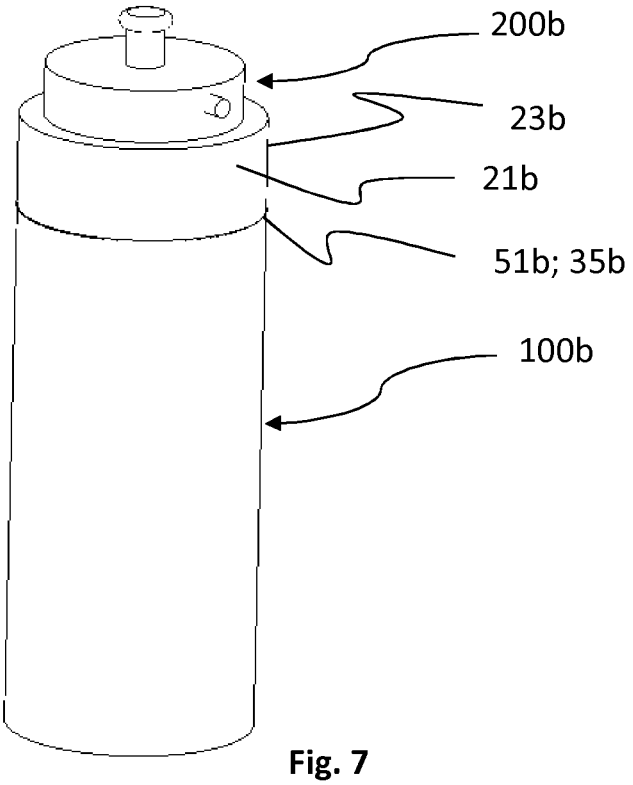
FIG. 7 discloses the lid mounted to the bottle via its first side.

The collar 23*b* has an axial extension sufficient to close-off the through-going venting holes 8*b* when the lid 200*b* is mounted via its first side 21*b* to the neck 4*b* of the bottle 100*b*. The lid 200*b* thereby acts as a traditional lid, completely closing-off the neck 4*b* and its mouth 6*b* in a leak-free manner. This is best seen in FIG. 7.

Now turning to FIG. 6 anew, the free end of the collar 23*b* comprises a second sealing surface 35*b*. When the lid 200*b* is mounted to the bottle 100*b* via its first side 21*b*, the second sealing surface 35*b* may sealingly abut a first sealing surface 51*b* which is formed by a radially extending circumferential edge 12*b* of the bottle neck 4*b*. The first sealing surface 51*b* and/or the first sealing surface 35*b* of the bottle neck 4*b* may be provided with an elastic sealing member (not disclosed).

The second side 22*b* of the lid 200*b* comprises third locking means 30*b*. The third locking means 30*b* is configured to selectively engage the neck 4*b* of the bottle 100*b* without the lid 200*b* closing-off the through-going venting holes 8*b*. The third locking means 30*b* is provided as a radially projecting pin 32*b*. The third locking means 30*b* is configured to engage the fourth locking means 40*b* of the bottle 100*b*, i.e. the groove 41*b*. The third locking means 30*b* and the fourth locking means 40*b* together form a bayonet joint.

When mounting the lid 200*b* to the neck 4*b* via the second side of the lid 200*b*, the pin 32*b* is inserted into the open end 42*b* of the groove 41*b* in the envelope surface of the neck 4*b* and then the lid 200*b* is pushed in the axial direction while also turning the lid 200*b*. The pin 32*b* will thereby engage the groove 41*b* and prevent removal of the lid 200*b* by a strict axial movement. When the lid 200*b* is mounted to the neck 4*b* via the second side 22*b* of the lid 200*b*, the effective engagement area is provided by the pin 32*b* of the third locking means 30*b* engaging the groove 41*b* of the second locking means 27*b*.

Figure 8:
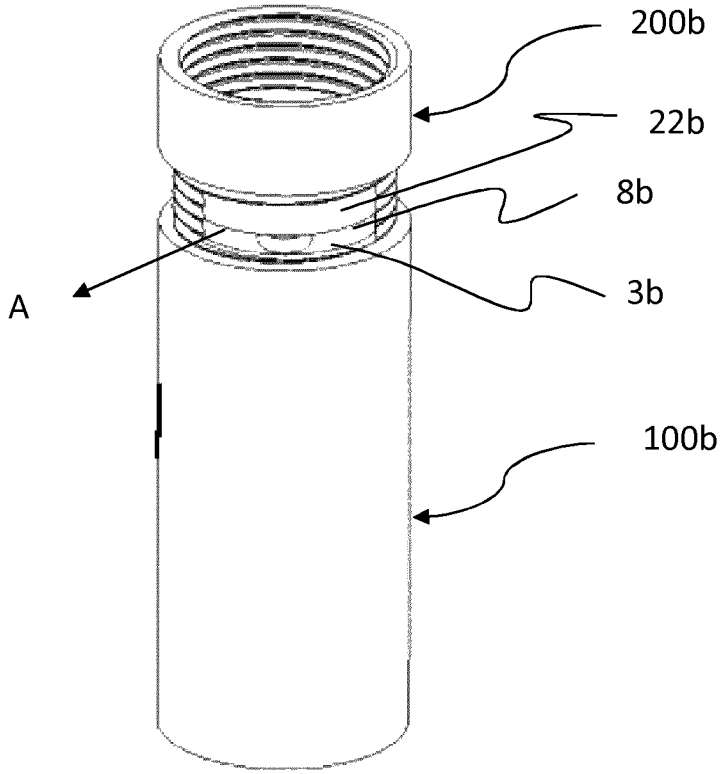
FIG. 8 discloses the lid mounted to the bottle via its second side.

Now turning to FIG. 8, the bottle 100*b* is disclosed with the lid 200*b* being mounted to the bottle 100*b* via its second side 22*b*. In this position the lid 200*b* is attached to the bottle 100*b*, however the venting holes 8*b* will remain open. Thereby, the venting-holes 8*b* provide a free passage extending in the radial direction (arrow A) allowing the interior of the compartment 3*b* to communicate with the ambience.

Now turning to FIGS. 9*a*-9*d*, a third embodiment of the reclosure system is disclosed. The system comprises a bottle 100*c*, see FIG. 9*a* and a reversible lid 200*c*, see FIG. 9*b*. Like previous embodiments, the bottle 100*c* has a bottom wall 1*c* and a side wall portion 2*c* which delimit a compartment 3*c*. Although the bottle 100*c* is disclosed as a cylinder having a circular cross-section it is to be understood that other cross-sections are possible. Also, depending on the cross-section, the number of side wall portions may vary.

The bottle 100*c* has a bottle neck 4*c*. The bottle neck 4*c* comprises a circumferential wall portion 5*c* having an axial extension. The bottle neck 4*c* has a circular cross-section. The bottle neck 4*c* has a mouth 6*c* in its free end which forms a through-going opening extending along the axial extension.

The free upper edge 11*c* of the bottle neck 4*c* is provided with a plurality of cut-outs 13*c* forming through-going venting holes 8*c*. The cut-outs 13*c* may have any axial extension and any arbitrary cross section. It is to be understood that it is sufficient to provide one through-going venting hole 8*c* with remained function.

The exterior surface of the circumferential wall portion of the bottle neck 4*c* comprises a first locking means 7*c* in the form of threads 9*c*. The first locking means 7*c* are arranged in a position axially below the through-going venting holes 8*c*, i.e. below a lower most point of the cut-outs 13*c*.

The inner wall 14*c* of the circumferential wall portion of the bottle neck 4*c* may be substantially smooth.

The bottle neck 4*c* comprises a radially extending first sealing surface 51*c*. The first sealing surface 51*c* is arranged in a position axially below the first locking means 7*c*. The first sealing surface 51*c* will be discussed below.

Figure 9A:
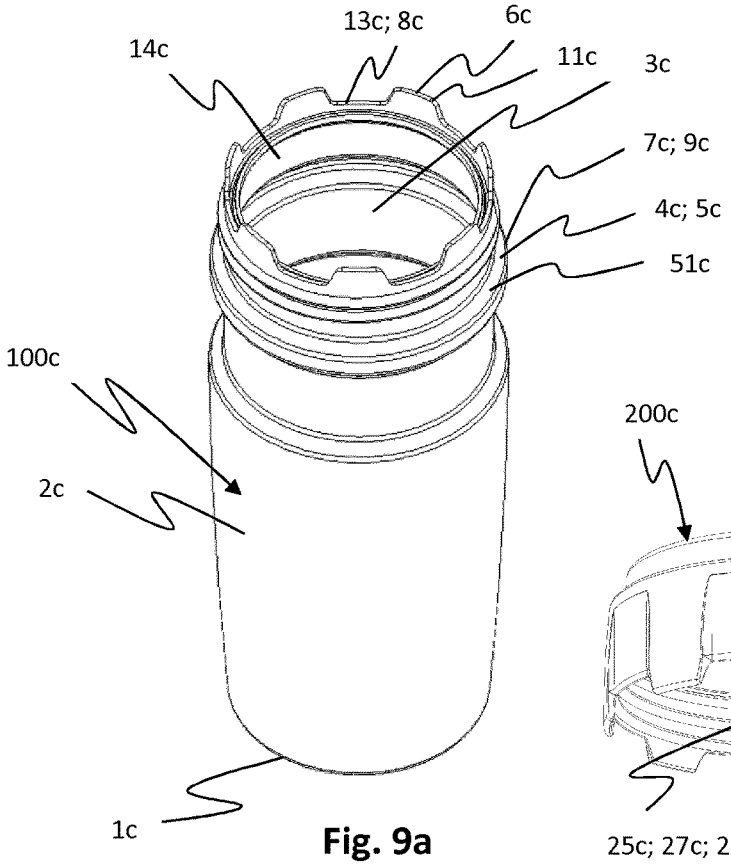
FIG. 9*a*-9*d* discloses a third embodiment of the reclosure system.
Figure 9B:
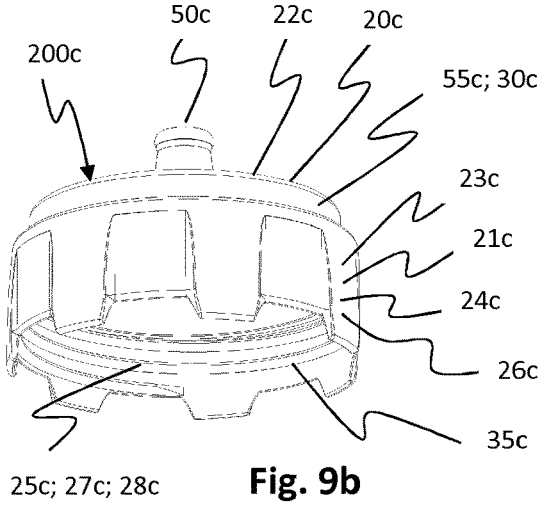
Figure 9C:
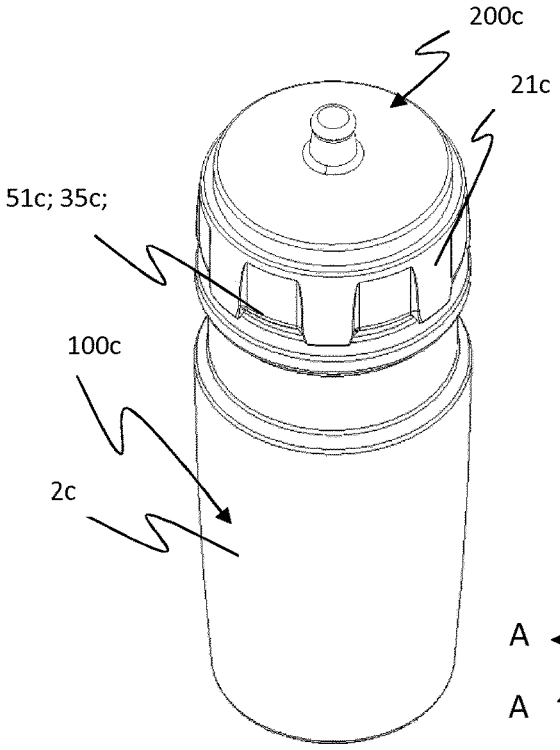

Now turning to FIG. 9*b* one embodiment of the reversible lid 200*c* is disclosed. The lid 200*c* comprises a radially extending disc 20*c* having a cross-section exceeding the cross-section of the mouth 6*c* of the bottle 100*c*. The lid 200*c* has a first side 21*c* and an opposite second side 22*c*. The lid 200*c* may comprise an optional nozzle 50*c* providing a through-going opening extending from the first side 21*c* of the lid 200*c* to the second side 22*c* of the lid 200*c*.

The first side 21*c* of the lid 200*c* comprises a collar 23*c* extending in the axial direction of the lid 200*c*. The collar 23*c* comprises a circumferential side wall portion 24*c* having an inner envelope surface 25*c* and an outer envelope surface 26*c*. The inner envelope surface 25*c* is provided with a second locking means 27*c*. The second locking means 27*c* is complementary to the first locking means 7*c* of the bottle 100*c*. Thus, the second locking means 27*c* is formed by threads 28*c* having a profile mating with the threads 9*c* of the first locking means 7*c*.

The collar 23*c* of the reversible lid 200*c* comprises a circumferentially extending second sealing surface 35*c*. The second sealing surface 35*c* is arranged on the inner envelope surface 25*c* below the second locking means 27*c*. The second sealing surface 35*c* is complementary to the first sealing surface 51*c* of the bottle neck 4*c*. Thereby, in a condition when the reversible lid 200*c* is mounted to the bottle neck 4*c* with the second locking means 27*c* engaging the first locking means 7*c*, see FIG. 9*c*, the second sealing surface 35*c* will sealingly abut the first sealing surface 51*c* and provide a fluid tight closure of the bottle 100*c*. The first sealing surface 51*c* and/or the second sealing surface 35*c* may be provided with an elastic sealing member (not disclosed). Accordingly, when the lid 200*c* is mounted to the bottle 100*c* via the first side 21*c*, the lid 200*c* acts as a traditional lid, completely closing-off the bottle neck 4*c* and its mouth 6*c* in a leak-free manner. The effective engagement area is provided by the threads 9*c* of the first locking means 7*c* engaging the threads 28*c* of the second locking means 27*c*.

Figure 9D:
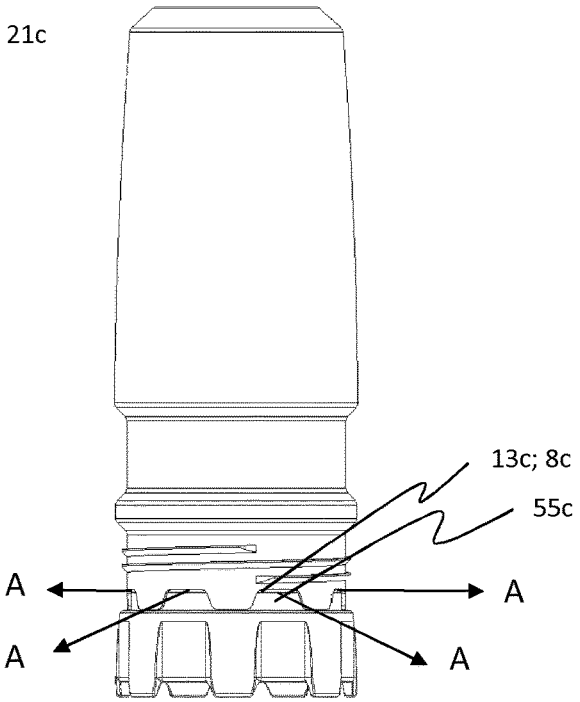

Now turning to FIGS. 9*b* and 9*d*, the second side 22*c* of the lid 200*c* comprises an axially and circumferentially extending abutment surface 55*c* forming the third locking means 30*c*. The abutment surface 55*c* has a continuous circumferential extension. The diameter as measured across the abutment surface 55*c* substantially corresponds to, or is slightly larger than, the inner diameter of the bottle neck 4*c* as measured at the inner wall 14*c* in the portions between the cut-outs 13*c* forming through-going venting holes 8*c*. Thereby, in a condition when the reversible lid 200*c* is mounted to the bottle neck 4*c* with the third locking means 30*c* engaging the bottle neck 4*c*, the reversible lid 200*c* will be maintained in this position by friction only between the abutment surface 55*c* and the inner wall 14*c* of the bottle neck 4*c*. It is to be understood that the abutment surface 55*c* and/or the inner wall 14*c* may be provided with non-disclosed friction means such as a surface texture or radially extending shoulders enhancing the frictional engagement between the abutment surface and the inner wall 14*c* of the neck 4*c*.

The circumferentially extending abutment surface 55*c* of the third locking means 30*c* has, as seen in the axial direction, a height being smaller than a maximum depth of the cut-out 13*c* in the free upper edge of the bottle neck 4*c*. Thereby, in a condition when the third locking means 30*c* engages the bottle neck 4*c*, substantially radially extending passages (arrows A) forming the through-going venting holes 8*c* are formed in the area between the abutment surface 55*c* and the lower most point of each cut-out 13*c*. This is best seen in FIG. 9*d*.

Now turning to FIGS. 10*a*-10*d* a fourth embodiment of the reclosure system is disclosed. The fourth embodiment differs from the third embodiment in the design of the lid 200*d*, see FIG. 10*b*. The design of the bottle 100*d* is the same as of the bottle 100*c* in the third embodiment, whereby reference is made to that embodiment to avoid undue repetition.

Figure 10A:
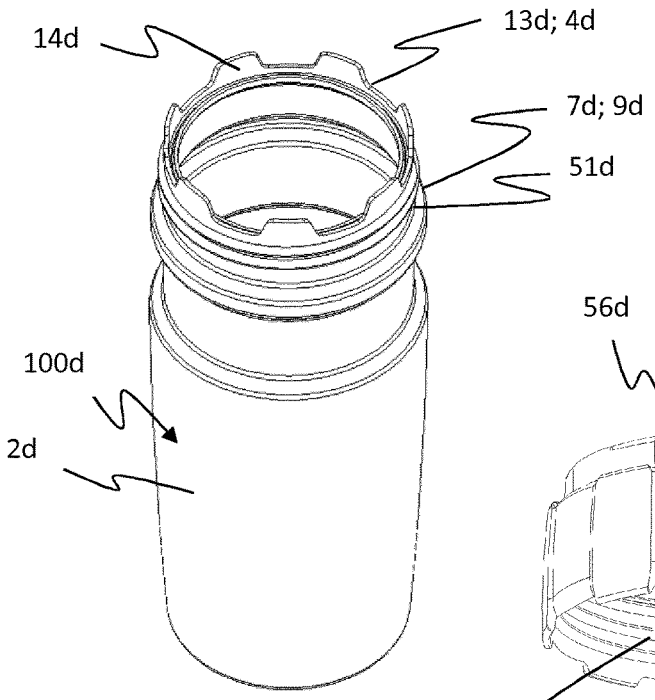
FIG. 10*a*-10*d* discloses a fourth embodiment of the reclosure system.
Figure 10B:
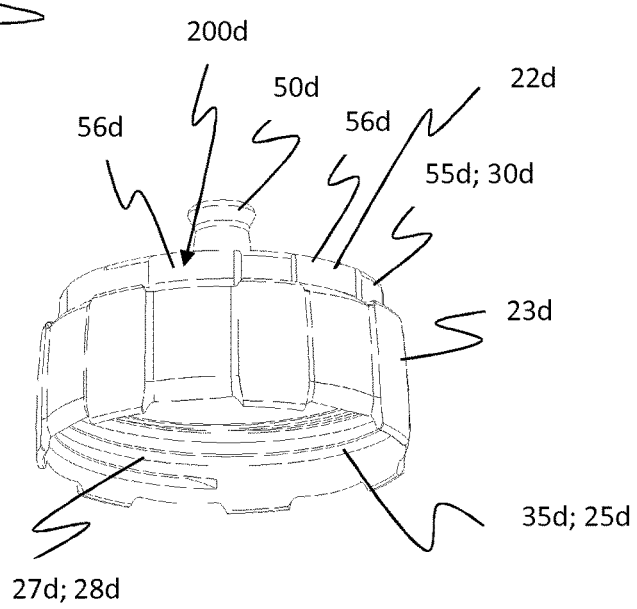

The lid 200*d* has the same overall design as the lid 200*c* of the third embodiment with the difference in the design of the axially and circumferentially extending abutment surface forming the third locking means 30*d*, see FIG. 10*b*.

The second side 22*d* of the lid 200*d* comprises an axially and circumferentially extending abutment surface 55*d* forming the third locking means 30*d*. The abutment surface 55*d* has a dis-continuous circumferential extension. The dis-continuous circumferential extension forms a plurality of radially and axially extending depressions 56*d*. It is to be understood that one depression 56*d* is sufficient.

The diameter as measured across the abutment surface 55*d* substantially corresponds to, or is slightly larger than, the inner diameter of the bottle neck 4*d* as measured at the inner wall 14*d* in the portions between the cut-outs 13*d*. Thereby, in a condition when the reversible lid 200*d* is mounted to the bottle neck 4*d* with the third locking means 30*d* engaging the bottle neck 4*d*, the lid 200*d* will be maintained in this position by friction only between the abutment surface 55*d* and the inner wall 14*d* of the bottle neck 4*d*. It is to be understood that the abutment surface 55*d* and/or the inner wall 14*d* may be provided with non-disclosed friction means such as a surface texture or radially extending shoulders enhancing the frictional engagement between the abutment surface and the inner wall 14*d* of the neck 4*d*.

Figure 10C:
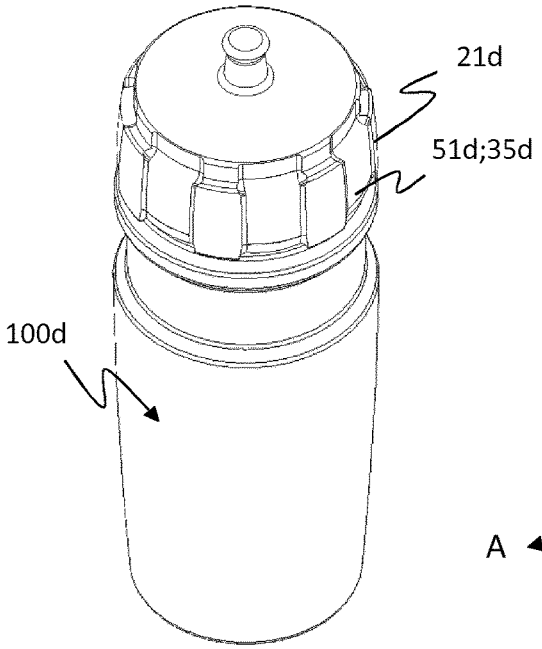
Figure 10D:
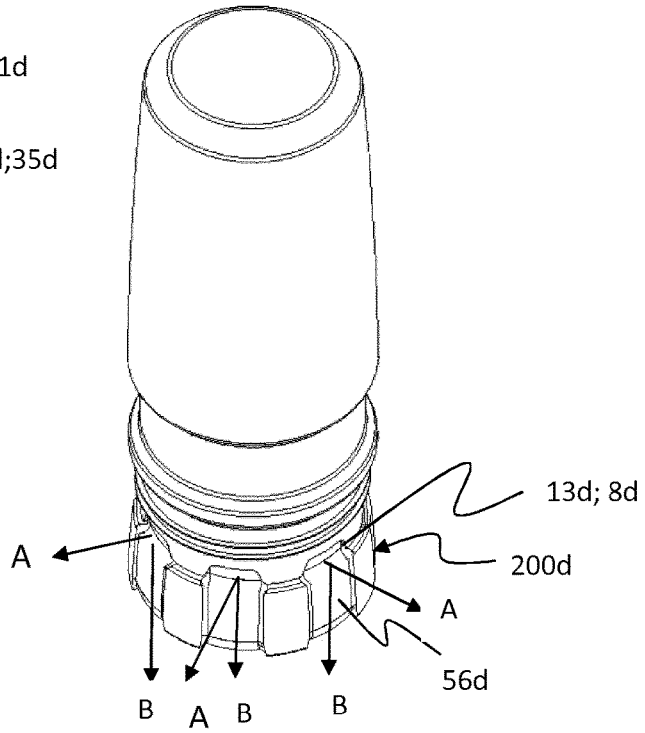

When mounting the lid 200*d* with the third locking means 30*d* engaging the bottle neck 4*d*, see FIG. 10*d*, the lid 200*d* should be turned so that the depressions 56*d* are axially aligned with the cut-outs 13*d* in the bottle neck 4*d*. Thereby the depressions 56*d* and the cut-outs 13*d* will provide substantially radially and axially extending passages (arrows A and B) forming said through-going venting holes 8*d*.

Now turning to FIGS. 10*b* and 10*c*, the collar 23*d* of the reversible lid 200*d* comprises a circumferentially extending second sealing surface 35*d*. The second sealing surface 35*d* is arranged on the inner envelope surface 25*d* below the second locking means 27*d*. The second sealing surface 35*d* is complementary to the first sealing surface 51*d* of the bottle neck 4*d*. Thereby, in a condition when the reversible lid 200*d* is mounted to the bottle neck 4*d* with the second locking means 27*d* engaging the first locking means 7*d*, the second sealing surface 35*d* will sealingly abut the first sealing surface 51*d* and provide a fluid tight closure of the bottle 100*d*. The first sealing surface 51*d* and/or the second sealing surface 35*d* may be provided with an elastic sealing member (not disclosed). Accordingly, when the lid 200*d* is mounted to the bottle 100*d* via the first side 21*d*, the lid 200*d* acts as a traditional lid, completely closing-off the bottle neck 4*d* and its mouth 6*d* in a leak-free manner. The effective engagement area is provided by the threads 9*d* of the first locking means 7*d* engaging the threads 28*d* of the second locking means 27*d*.

Now turning to FIGS. 11*a*-11*d* a fifth embodiment of the reclosure system is disclosed. The fifth embodiment differs from the third embodiment in the design of bottle neck 4*e*, see FIG. 11*a* and the lid 200*e*, see FIG. 11*b*.

The design of the bottle 100*e* is substantially the same as the bottle 100*c* in the third embodiment with the difference in that the bottle neck 4*e* lacks any through-going openings or cut-outs in its circumferential side wall. Instead the upper free edge of the bottle neck is continuous. Reference is made to the bottle of the third embodiment to avoid undue repetition of the design of the bottle 100*e*.

The design of the lid 200*e* is the same as the lid 200*d* in the fourth embodiment, i.e. the second side 22*e* of the lid 200*e* comprises an axially and circumferentially extending abutment surface 55*e* forming the third locking means 30*e*. The abutment surface 55*e* has a dis-continuous circumferential extension. The dis-continuous circumferential extension forms a plurality of radially and axially extending depressions 56*e*. It is to be understood that one depression 56*e* is sufficient.

The diameter as measured across the abutment surface 55*e* substantially corresponds to, or is slightly larger than, the inner diameter of the bottle neck 4*e* as measured at the inner wall 14*e*. Thereby, in a condition when the reversible lid 200*e* is mounted to the bottle neck 4*e* with the third locking means 30*e* engaging the first locking means 7*e* in the bottle neck 4*e*, the lid 200*e* will be maintained in this position by friction only between the abutment surface 55*e* and the inner wall 14*e* of the bottle neck 4*e*. It is to be understood that the abutment surface 55*e* and/or the inner wall 14*e* may be provided with non-disclosed friction means such as a surface texture or radially extending shoulders enhancing the frictional engagement between the abutment surface and the inner wall 14*e* of the neck 4*e*.

Figure 11A:
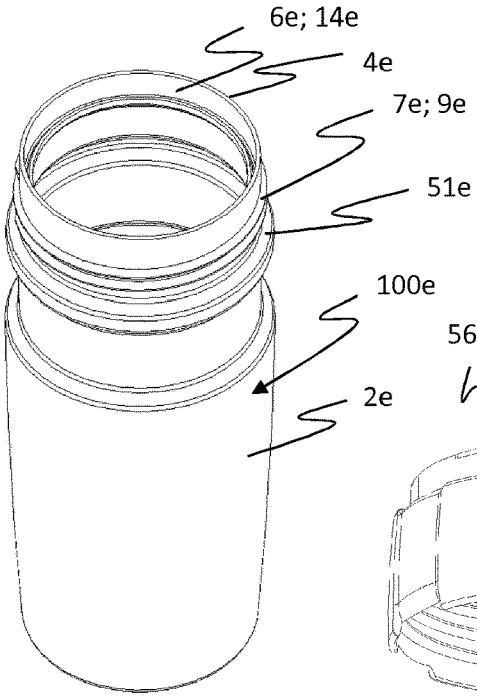
FIG. 11*a*-11*d* discloses a fifth embodiment of the reclosure system.
Figure 11B:
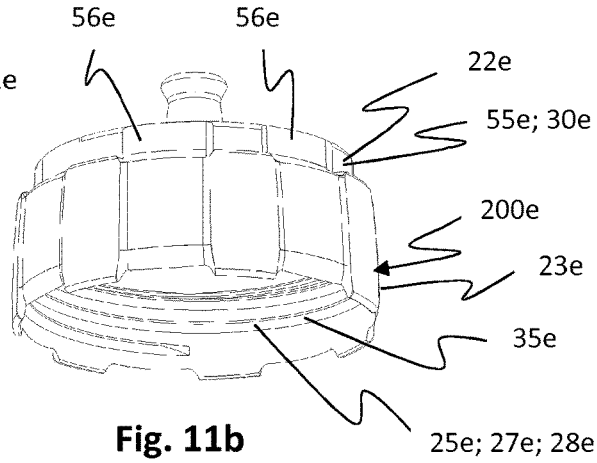
Figure 11C:
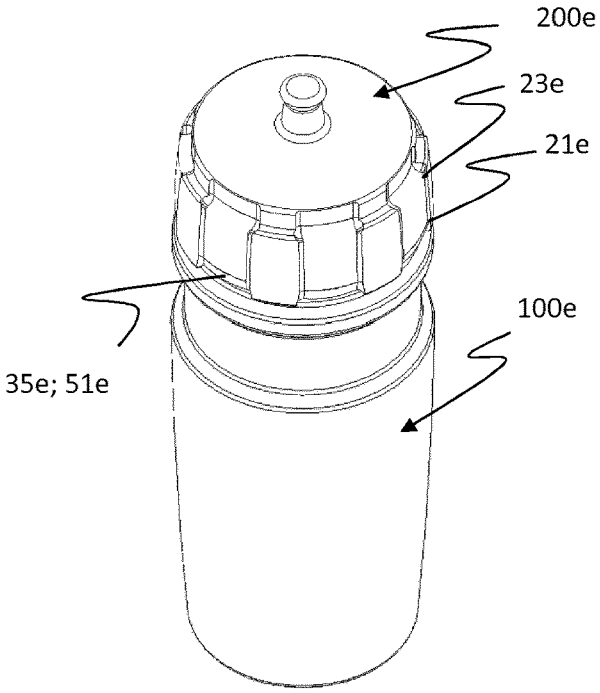
Figure 11D:
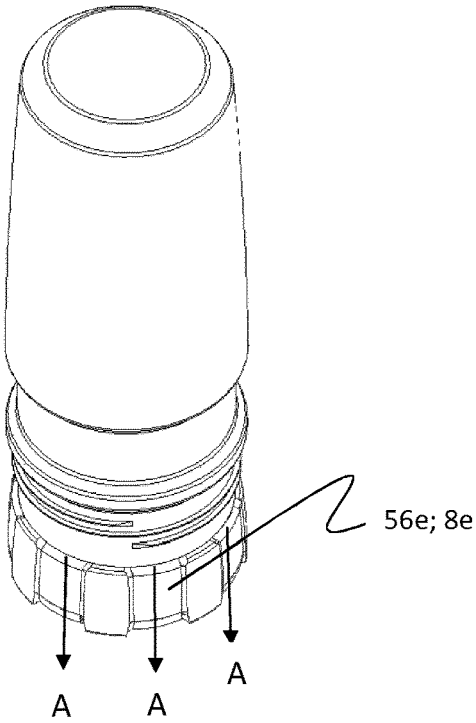

When mounting the lid 200*e* with the third locking means 30*e* engaging the bottle neck 4*e*, see FIG. 11*d*, the depressions 56*e* will provide substantially axially extending passages (arrows A) forming said through-going venting holes 8*e*. One advantage with this fifth embodiment over the fourth embodiment is that there is no need to align the depressions 56*e* with any cut-outs in the bottle neck 4*e*.

The collar 23*e* of the reversible lid 200*e* comprises in its lower free end a circumferentially extending second sealing surface 35*e*. The second sealing surface 35*e* is arranged on the inner envelope surface 25*e* below the second locking means 27*e*. The second sealing surface 35*e* is complementary to the first sealing surface 51*e* of the bottle neck 4*e*. Thereby, in a condition when the reversible lid 200*e* is mounted to the bottle neck 4*e* with the second locking means 27*e* engaging the first locking means 7*e*, see FIG. 11*c*, the second sealing surface 35*e* will sealingly abut the first sealing surface 51*e* and provide a fluid tight closure of the bottle 100*e*. The first sealing surface 51*e* and/or the second sealing surface 35*e* may be provided with an elastic sealing member (not disclosed). Accordingly, when the lid 200*e* is mounted to the bottle 100*e* via the first side 21*e*, the lid 200*e* acts as a traditional lid, completely closing-off the bottle neck 4*e* and its mouth 6*e* in a leak-free manner. The effective engagement area is provided by the threads 9*e* of the first locking means 7*d* engaging the threads 28*e* of the second locking means 27*e*. Optionally, the continuous upper free edge of the bottle neck may sealingly abut the inner surface of the disc of the lid 200*e* when the lid 200*e* is mounted to the bottle 100*e* via the first side 21*e*.

Figure 12:
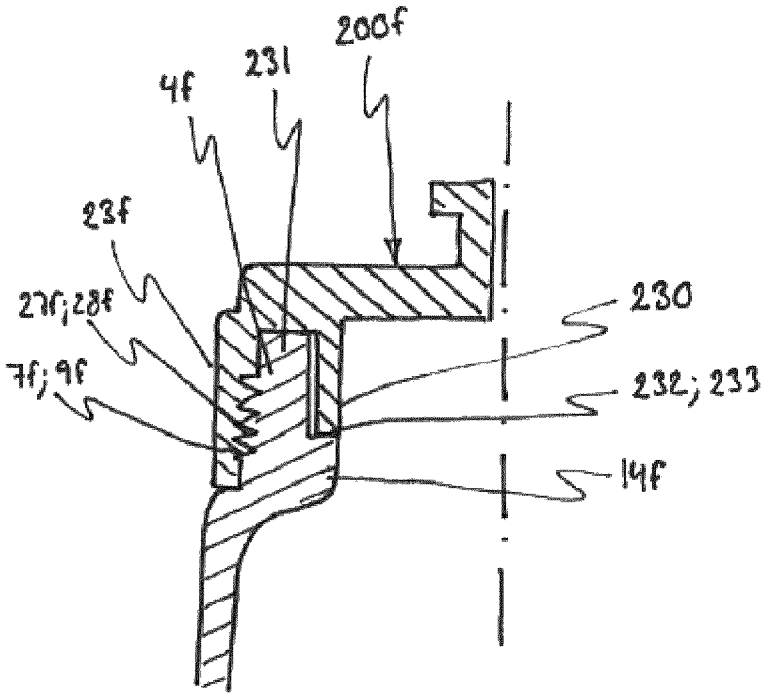
FIG. 12 discloses a supplementary sealing arrangement.

Now turning to FIG. 12, a supplementary sealing arrangement between the bottle neck and the reversible lid is disclosed highly schematically. The sealing arrangement may be directly applicable to any of the previous embodiments, and especially the third, fourth and fifth embodiments. All other features and aspects of the lid 200*a*-200*e* and the bottle neck 4*c*-4*e* than those described below may remain the same and are included by reference. In this embodiment, the lid 200*f* comprises a supplementary inner collar 230. The inner collar 230 has a circumferential, continuous axial extension and is arranged on a radial distance from the outer collar 23*f*. Thereby a radially extending gap 231 is provided which is configured to contain at least a portion of the bottle neck 4*f* when the lid 200*f* is mounted thereto. The inner wall 14*f* of the bottle neck 4*f* comprises a third radially extending sealing surface 232. The collar 23*f* of the lid 200*f* is provided with second locking means 27*f* in the form of threads 28*f* on its inner wall to allow a threading engagement with the first locking means 7*f* in the form of threads 9*f* on the exterior wall of the bottle neck 4*f*. When the lid 200*f* is threaded onto the bottle neck 4*f* with the first locking means 7*f* engaging the second locking means 27*f*, the free edge 233 of the supplementary inner collar 230 will sealingly abut the third sealing surface 232. Thereby, a leak free engagement between the lid 200*f* and the bottle neck 4*f* is provided for. A non-disclosed elastic sealing may be arranged in the interface between the third sealing surface 232 and the free edge 233.

The invention claimed is:

1. A reclosure system comprising a bottle and a reversible lid, wherein:

the bottle comprises a bottle neck having an axial extension and a mouth providing access to the interior of the bottle, and said bottle neck further comprising a circumferential wall portion being provided with a first locking means, and the reversible lid being configured to be removably connected to the bottle neck, wherein a first side of the reversible lid comprises a collar comprising a second locking means configured to selectively allow the reversible lid to sealingly close off the mouth of the bottle neck by the second locking means engaging the first locking means of the bottle neck, and a second side of the reversible lid, opposite the first side, comprising a third locking means configured to selectively engage the bottle neck; whereby in a condition when the third locking means engages the bottle neck, a through-going venting hole is defined in an interface between a discontinuous surface of the reversible lid and a continuous free upper edge of the bottle neck, said through-going venting hole allowing a communication between the interior of the bottle and an exterior of the bottle.

2. The reclosure system according to claim 1, wherein the bottle neck comprises a radially extending first sealing surface, and wherein the collar of the reversible lid comprises a complementary circumferential second sealing surface configured to sealingly abut the first sealing surface in a condition when the reversible lid is mounted to the bottle neck with the second locking means engaging the first locking means.

3. The reclosure system according to claim 1, wherein the third locking means is provided by an axially and circumferentially extending abutment surface configured to engage an inner wall of the circumferential wall portion of the bottle neck.

4. The reclosure system according to claim 3, wherein said circumferentially extending abutment surface has a discontinuous circumferential extension forming at least one radially and axially extending depression, wherein said at least one depression is in a condition when the third locking means engages the bottle neck that defines a substantially radially and axially extending passage forming said through-going venting hole.

5. The reclosure system according to claim 1, wherein an effective engagement area between the first and the second locking means as seen along the axial extension of the bottle neck is larger than the effective engagement area between the bottle neck and the third locking means.

6. The reclosure system according to claim 1, wherein the first locking means are arranged on an inner portion of the circumferential wall portion of the bottle neck and wherein the second locking means are arranged on an outer envelope surface of the collar of the reversible lid; or wherein the first locking means are arranged on an outer envelope surface of the circumferential wall portion of the bottle neck and wherein the second locking means are arranged on an inner envelope surface of the collar.

7. The reclosure system according to claim 1, wherein the reclosable bottle is used for food, beverages or medical or laboratory experiments.

* * * * *